US007895753B2

(12) United States Patent
Longerich et al.

(10) Patent No.: US 7,895,753 B2
(45) Date of Patent: Mar. 1, 2011

(54) SHAVING SYSTEM

(75) Inventors: Wolfgang Longerich, Liederbach (DE); Rolf Eimecke, Obertshausen (DE); Andreas Peter, Kronberg (DE); Stefan Eich, Oberursel (DE)

(73) Assignee: Braun GmbH, Kronberg (DE)

( * ) Notice: Subject to any disclaimer, the term of this patent is extended or adjusted under 35 U.S.C. 154(b) by 161 days.

(21) Appl. No.: 11/849,492

(22) Filed: Sep. 4, 2007

(65) Prior Publication Data

US 2008/0047146 A1 Feb. 28, 2008

Related U.S. Application Data

(63) Continuation of application No. PCT/EP2006/001345, filed on Feb. 15, 2006.

(30) Foreign Application Priority Data

Mar. 5, 2005 (DE) ..... 10 2005 010 244

(51) Int. Cl.
*B26B 19/02* (2006.01)

(52) U.S. Cl. ..... 30/43.92; 30/346.51

(58) Field of Classification Search ..... 30/43.7, 30/43.8, 43.9, 43.91, 43.92, 346.51; 76/104.1
See application file for complete search history.

(56) References Cited

U.S. PATENT DOCUMENTS

| | | | | |
|---|---|---|---|---|
| 2,833,033 | A * | 5/1958 | Heyek | 30/43.92 |
| 2,841,867 | A | 7/1958 | Padgett | |
| 3,060,570 | A | 10/1962 | Wahl | |
| 3,201,178 | A | 8/1965 | Okubo | |
| 3,555,676 | A * | 1/1971 | Heyek | 30/43.92 |
| 3,858,461 | A * | 1/1975 | Tolmie | 76/104.1 |
| 5,802,932 | A * | 9/1998 | Vankov et al. | 76/104.1 |
| 6,082,005 | A * | 7/2000 | Tezuka | 30/43.92 |
| 6,223,438 | B1 * | 5/2001 | Parsonage et al. | 30/43.92 |
| 7,243,576 | B2 * | 7/2007 | Okabe | 76/104.1 |
| 2005/0274019 | A1 * | 12/2005 | Inoue et al. | 30/43.7 |

FOREIGN PATENT DOCUMENTS

| | | |
|---|---|---|
| DE | 1 004 519 | 3/1957 |
| DE | 198 49 537 | 5/1999 |
| DE | 697 03 658 | 5/2001 |
| EP | 1 182 014 | 2/2002 |
| WO | WO2004/076135 | 9/2004 |
| WO | WO 2006/094605 A1 * | 9/2006 |

* cited by examiner

*Primary Examiner*—Hwei-Siu C Payer
(74) *Attorney, Agent, or Firm*—John M Howell; Jay A Krebs

(57) ABSTRACT

A shaving cutter assembly for an electric hair cutting appliance the shaving cutter assembly including a shaving cutter and a carrier to which the shaving cutter is fixedly connected via at least one metallic weld.

16 Claims, 5 Drawing Sheets

SHAVING SYSTEM

RELATED APPLICATIONS

This application is a continuation of, and claims priority under 35 U.S.C. 120 from, International Application No. PCT/EP2006/001345, filed Feb. 15, 2006, which claimed priority under 35 U.S.C. 119(a) from German Patent Application DE 10 2005 010244.1, filed Mar. 5, 2005. Both priority applications are incorporated herein in their entirety.

TECHNICAL FIELD

This invention relates to a cutter assembly for an electric hair cutting appliance, an electric hair cutting appliance equipped with such a shaving cutter assembly and a method of manufacturing such a shaving cutter assembly.

BACKGROUND

In general, as a rule, an electric shaving appliance has a shaving cutter or undercutter and an overcutter or foil which lie close together and move relative to each other to cut beard hairs entering the region between the overcutter and the undercutter.

Such a shaving apparatus is discussed in EP 1 182 014 A2, in which an electric shaving apparatus has two undercutters and one overcutter that is constructed as a shaving foil. The undercutters are made to perform an oscillatory linear motion, severing in the process the beard hairs in cooperating relationship with the overcutter.

WO 2004/076135 A1 also discusses an electric shaving apparatus with two undercutters which oscillate relative to an overcutter constructed as a shaving foil. The undercutters are each connected to a drive element via a coupling element. For this purpose the respective undercutter is arranged on the coupling element such that projections formed on the coupling element engage in recesses of the undercutter.

The shaving results achievable with a shaving apparatus of such construction depend, among other factors, on the accuracy of the cooperating relationship between the undercutters and the overcutter.

SUMMARY

One aspect of the invention features a shaving cutter of an electric hair cutting appliance that is permanently fixed to a carrier. The carrier is acted upon by a drive mechanism of the electric cutting appliance to cause the carrier and shaving cutter to oscillate.

In some embodiments, the shaving cutter assembly has a shaving cutter including multiple connected cutting blades for severing hairs and a carrier to which the shaving cutter is fixedly connected. More particularly, the shaving cutter and the carrier are connected to each other via at least one metallic weld. The carrier serves to transfer oscillation or other movement from the drive mechanism of the appliance to the shaving cutter.

The shaving cutter is precisely and permanently fixed to the carrier. The metallic weld is very durable, has low space requirements and can be produced quickly and cost-effectively.

In a preferred embodiment of the invention, at least one mounting structure is provided on the shaving cutter and the weld is arranged in the region of the mounting structure. In this arrangement, the mounting structure is configured to be more readily deformable than the shaving cutter. For example, the mounting structure may be connected to the shaving cutter by a web or region of reduced material cross-section. Stresses and deformation created during production of the weld are isolated by the region of the reduced material cross-section, eliminating or reducing the transfer of stress to the shaving cutter. Consequently, it is possible to avoid undesirable deformation of the shaving cutter and to achieve good dimensional stability. This is an important factor in achieving good shaving results.

Several welds may be formed per mounting structure. In such cases, the welds are preferably arranged to at least partially balance stresses caused by the welds. For example, the welds may be formed at mutually symmetrical locations on the mounting structure. These arrangements lead in turn to any distortions in the shaving cutter being maintained within tolerance.

The mounting structure and the shaving cutter are preferably integrally made of one piece. In addition it is advantageous for the mounting structure to be connected to the shaving cutter via a neck region or web of reduced cross-section. The web serves to isolate the weld or several welds from the shaving cutter and to minimize any weld-induced distortions in the shaving cutter.

The mounting structure may embrace the carrier on multiple sides. This makes it easier to fixedly locate the shaving cutter on the carrier and results in a reliable hold. In this arrangement, according to one variation, the mounting structure is adapted to continuously conform with the shape of the carrier. According to another variant, the mounting structure deviates from the shape of the carrier in a region adjoining the weld, to provide a gap between the mounting structure and the carrier. In this region, the mounting structure includes a reduced material cross-section so that any stresses, or deformations are further isolated from the shaving cutter.

The shaving cutter assembly may be constructed such that the mounting structure has at least one holding arm. It is further advantageous for the mounting structure to have two symmetrically constructed holding arms between which the carrier is fixed. With this embodiment, it is possible to achieve a particularly effective suppression, or isolation of stresses.

The shaving cutter may be constructed as an undercutter having multiple connected blades adapted to be driven in an oscillating motion by the carrier. In particular the multiple blades of the shaving cutter may be bent such that the shaving cutter has a U-shaped cross-section. The blades of the shaving cutter may have a material thickness of less than 1 mm, preferably less than 0.5 mm and in particular around 0.3 mm. Preferably, provision is made for another shaving cutter, such as an overcutter foil, for cooperation with the shaving cutter.

The invention relates furthermore to an electric hair cutting appliance with at least one shaving cutter assembly constructed as discussed above.

Another aspect of the invention features a method of manufacturing a shaving cutter assembly for an electric hair cutting appliance, in which a shaving cutter for severing hairs is fixedly connected to at least one carrier. The method is characterized in that the shaving cutter and the carrier are connected to each other by at least one metallic weld.

It is particularly advantageous for several welds to be formed simultaneously. In this way, it is possible to restrict the development of stresses during formation of the welds. A similar effect is achievable if the energy for producing several welds is supplied successively over time, with the respective time difference being selected to be so small that molten material exists simultaneously in the region of several welds.

The details of one or more embodiments of the invention are set forth in the accompanying drawings and the description below. Other features, objects, and advantages of the invention will be apparent from the description and drawings, and from the claims.

DESCRIPTION OF DRAWINGS

The present invention will be explained in greater detail in the following with reference to the embodiments illustrated in the accompanying drawings. Like reference symbols in the various drawings indicate like elements.

DETAILED DESCRIPTION

Figure 1:
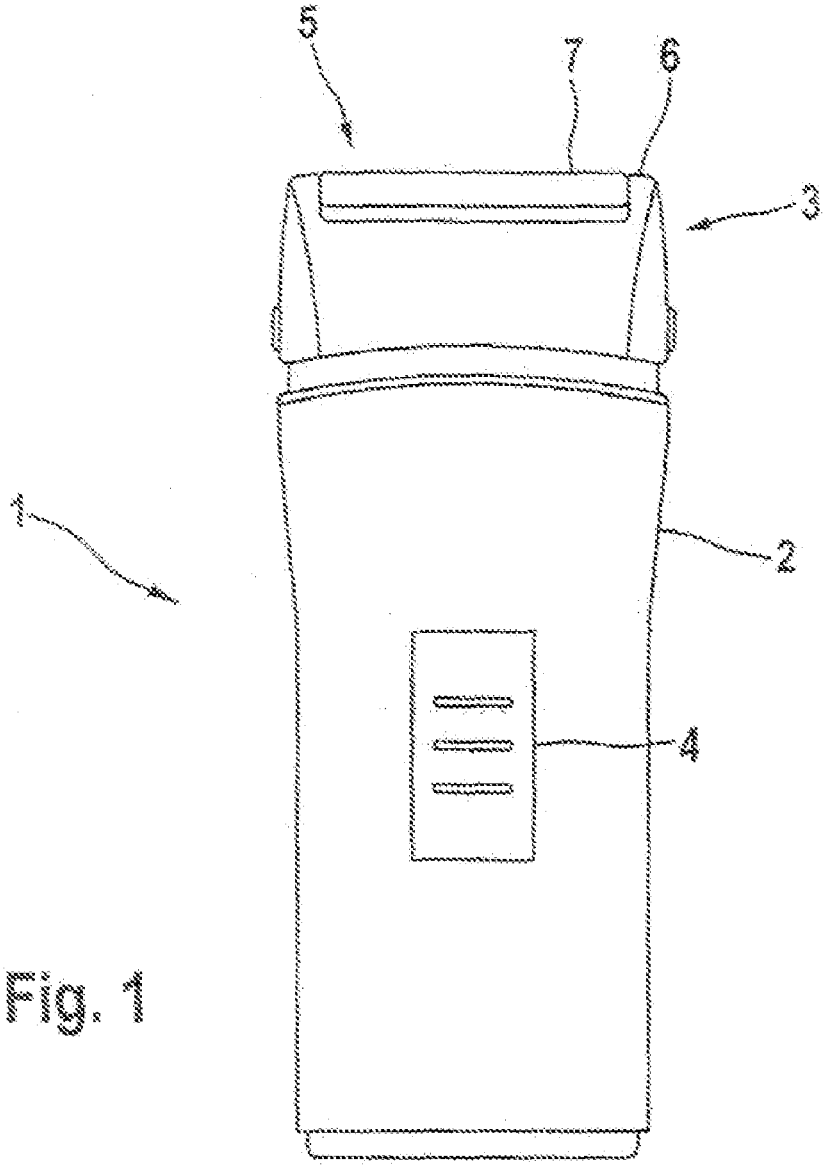
FIG. 1 is a side view of an embodiment of an electric shaving appliance.

FIG. 1 shows a side view of an embodiment of an electric shaving appliance 1. The shaving appliance 1 includes a housing 2, which can be held in the hand, and a shaving head 3 attached thereto. Arranged on the housing 2 is a switch 4 for switching the shaving appliance 1 on and off. The shaving head 3 includes a shaving cutter assembly 5 and shaving foil 7 arranged in a mounting frame 6 to cooperate with the shaving cutter assembly 5.

Figure 2:
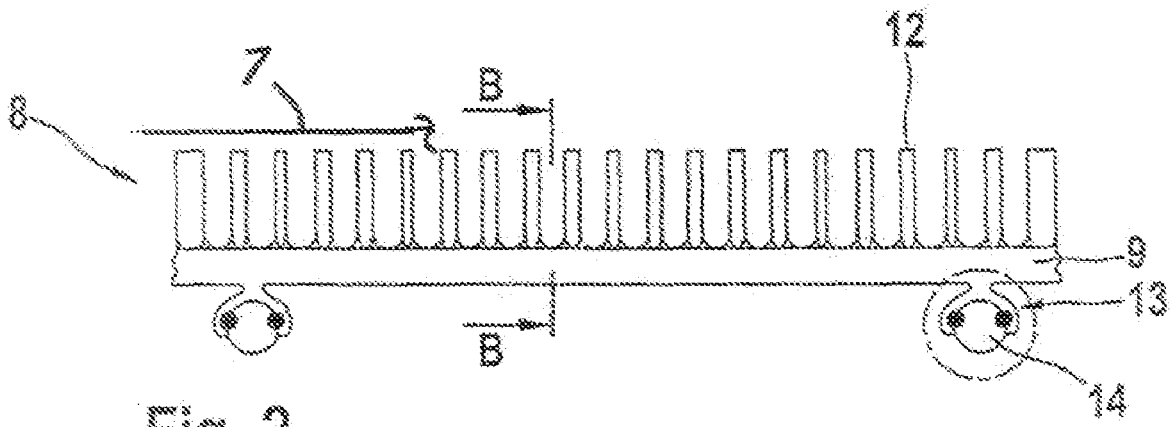
FIG. 2 is a side view of an embodiment of a shaving cutter constructed in accordance with the invention.
Figure 3:
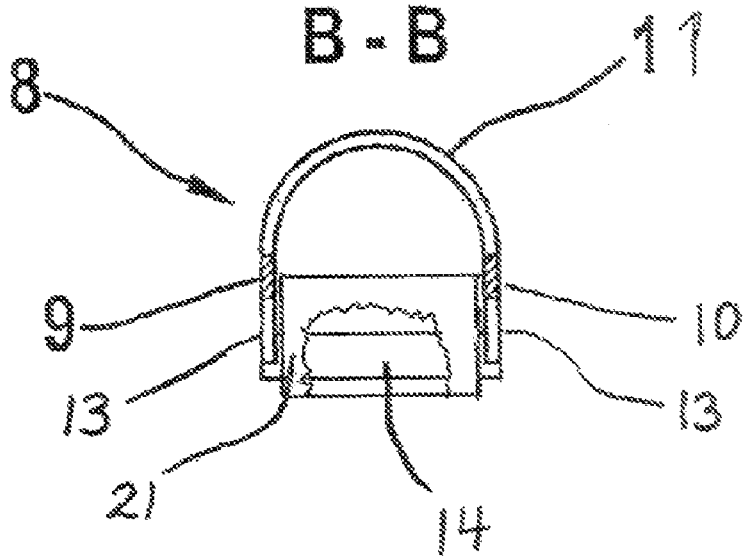
FIG. 3 is a sectional view of the shaving cutter of FIG. 2.

FIG. 2 is a side view of an example of a shaving cutter or undercutter 8. A related sectional view is shown in FIG. 3. The shaving cutter 8 represents another component of the shaving cutter assembly 5 and, in the mounted state, lies close to the inner side of the shaving foil 7 shown in FIG. 1. During operation of the shaving appliance 1, the shaving cutter 8 is set in an oscillatory linear motion relative to the shaving foil 7. Hairs passing through the shaving foil 7 up to the shaving cutter 8, are caught between the shaving cutter 8 and the shaving foil 7 and are severed. Alternatively, the overcutter may include blade sections like the undercutter.

With reference to FIGS. 2-3, in its cross-section, the shaving cutter 8 is of a U-shaped configuration and is made up of a first base 9, a second base 10 and an arcuate section 11 arranged between the bases 9 and 10. Disposed at regular relative distances in the longitudinal direction of the shaving cutter 8 are multiple individual blades 12 forming arcuate section 11. The individual blades 12 are constructed to be sharp-edged. Formed on each base 9 and 10 of the shaving cutter 8 are two mounting structures 13 with which the shaving cutter 8 is fastened to two carrier shafts 14 that are oriented in a direction transverse to the longitudinal extension of the shaving cutter 8. The carrier shafts 14 are engaged by a drive system 21 of the shaving appliance 1 operable to set the shaving cutter 8 in an oscillatory linear motion. The construction of the mounting structures 13 will be described in detail with reference to FIG. 4.

Figure 4:
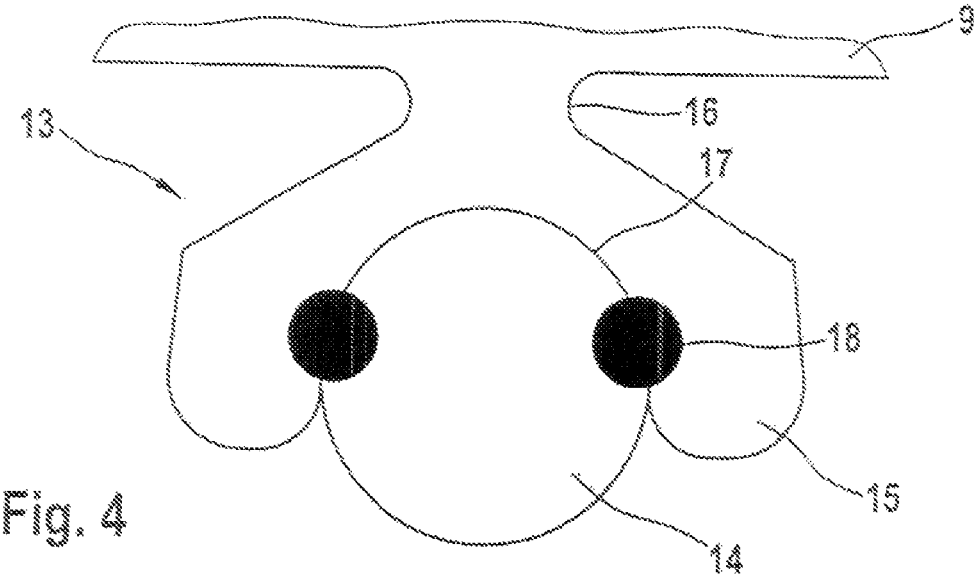
FIG. 4 is an enlarged detail view of FIG. 2 in the region of one of the mounting structures.

FIG. 4 shows an enlarged detail from FIG. 2 in the region of one of the mounting structures 13. In the embodiment shown, the mounting structure 13 is symmetrically and integrally formed with the first base 9 of the shaving cutter 8. In this arrangement, the mounting structure 13 has two holding arms 15 in the form of a fork partially embracing the illustrated carrier 14. The two holding arms 15 unite in a neck region or web 16 via which the mounting structure 13 is connected to the first base 9 of the shaving cutter 8. The web 16 extends laterally parallel to the outer contour of the first base 9 of the shaving cutter 8 to a distance smaller than the lateral extension of the two holding arms 15. The holding arms 15 rest with inner surfaces 17 against the carrier 14. The interface between the holding arms 15 and carrier 14 is shown here to be circular or arc-shaped but may be of any other suitable shape.

The carrier shafts 14 are made of metal, preferably steel. The shaving cutter 8 is made of metal at least in the region of the mounting structures 13. Preferably the shaving cutter 8 is made entirely of metal, with steel being again particularly well suited as a material. The material thickness of the shaving cutter 8 is less than 1 mm. Preferably a material thickness of less than 0.5 mm is selected. In the embodiment shown, the material thickness is around 0.3 mm. For example, the shaving cutter 8 and holding arms 15 may be formed by stamping or die cutting a steel sheet that is then bent into a U-shaped elongated form and fixed in this shape by attachment of carrier shafts 14 at holding arms 15.

To fixedly locate the mounting structure 13 on the carrier shafts 14, the mounting structure 13 and each carrier shaft 14 are welded together. In the embodiment shown, two weld points 18 are produced near the free ends of the holding arms 15 in mutually symmetrical positions. Between the weld points 18 and the web 16 the holding arms 15 each have a locally reduced material cross-section.

The weld points 18 may be produced by any suitable means such as by laser welding. During laser welding, the selected boundary regions between the holding arms 15 and the carrier shaft 14 are exposed briefly to a high-energy laser beam. This leads to local melting of the material in the region of the laser beam. During cooling, the molten material of the holding arm 15 fuses with the molten material of the carrier shaft 14. The melting takes place within a period of around 1 ms to 10 ms and is performed for both weld points 18 either simultaneously or in quick succession. The time offset for melting the two weld points 18 is a maximum of around 1 ms, which means that the material in the region of the second weld point 18 has already been melted before the material in the first weld point 18 has solidified. Simultaneous melting in the region of the two weld points 18 is achievable, for example, with the aid of a bifocal laser beam which is adjusted such that one focus point is produced in the region of each of the two weld points 18. When the molten regions solidify, stresses develop due to the reduction in volume and contraction during cooling. In particular, tensile stresses develop normal to the enveloping surface of the melt volume, which corresponds to the weld points 18 illustrated. The stresses can be reduced to a certain degree using a small melt volume and a small weld gap.

Within the scope of the invention several provisions are made enabling the stresses to be limited to very small values. One of these provisions entails forming several weld points 18 at least approximately simultaneously in the manner described so that the stresses partially cancel out each other during contraction of the melt volume. For example, the four weld points 18, by means of which a single carrier shaft 14 is joined to both a mounting structure 13 of the first base 9 and to a mounting structure 13 of the second base 10 of the shaving cutter 8, can be produced simultaneously or approximately simultaneously.

The individual weld points 18 may be arranged such that the stresses are cancelled, after cooling of the melts in the weld gap normal to the enveloping surface of the melt volume. In the example of FIG. 4, the weld points 18 are arranged symmetrically opposite each other for this purpose.

If stresses develop nevertheless, their impact on the shape of the shaving cutter 8 may be limited by arranging for the mounting structures 13 to deform more easily than the shaving cutter 8. This may be achieved by the forked shape of the mounting structures 13 and by the locally reduced material cross-section of the holding arms 15.

Figure 5:
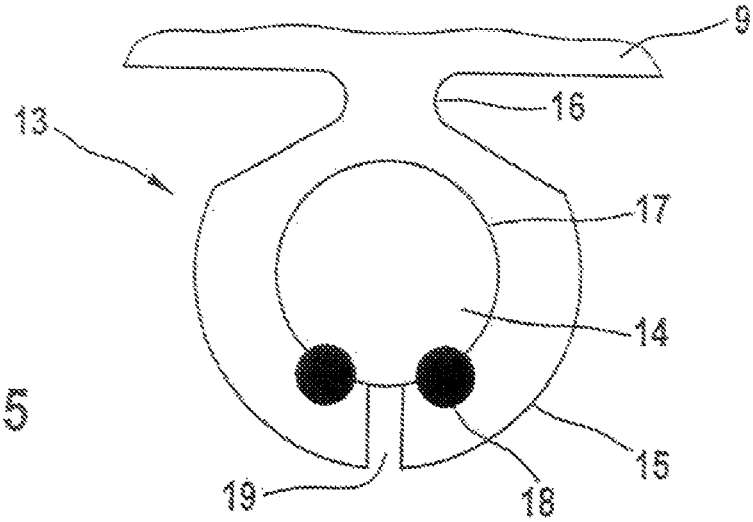
FIGS. 5 and 6 are views of further embodiments of the shaving cutter in a representation corresponding to FIG. 4, showing the respective mounting structures fixedly located on the carrier with two weld points each.
Figure 6:
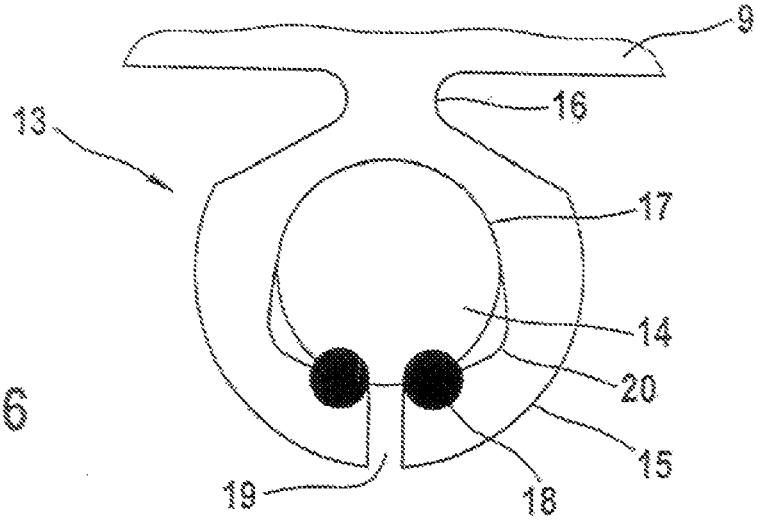

The stresses acting on the shaving cutter 8 can be limited particularly effectively by the described steps being applied in combination. However, it is also possible for the described characteristics to be employed individually or in sub-combinations. The described arrangement of the weld points 18 and the simultaneous or approximately simultaneous welding are preferably used in combination. Further alternative examples are illustrated in FIGS. 5 and 6. As a single provision, it is possible to use the easy deformability of the mounting structures 13. Examples of this are shown in FIGS. 7 to 10.

FIGS. 5 and 6 show further examples of the shaving cutter 8 in a representation corresponding to FIG. 4, in which the mounting structures 13 are fixedly located on the carrier shaft 14 with two weld points 18 each. In both examples, the carrier shaft 14 is embraced nearly completely by the holding arms 15 of the mounting structure 13, in each case but for a small gap 19. The gap 19 is formed in each case between the free ends of the holding arms on a side of the mounting structure 13 opposite the web 16. One weld point 18 each is produced on both sides adjacent to the gap 19. In the example shown in FIG. 5, the respective inner surface 17 of the two holding arms 15 is entirely shaped in the manner of a circular arc. In the example shown in FIG. 6, by contrast, only a sub-region of the respective inner surface 17 of the two holding arms 15 is constructed in the shape of a circular arc. In this example the inner surface 17 deviates in each case in a region of the holding arm 15 adjoining the weld point 18 from the shape of a circular arc such that initially the radii increase progressively and then are reduced again to the point where the circular arc is regained. Each holding arm 15 thus has, adjoining its weld point 18, a gap 20 in the region of which the inner surface 17 of the holding arm 15 is spaced from the carrier shaft 14, thereby reducing the material cross-section of the holding arm 15. In this way it is possible to further improve the reduction of stresses.

FIGS. 7 through 10 show examples of the shaving cutter 8 in a representation corresponding to FIG. 4, in which the mounting structures 13 are fixedly located on the carrier shaft 14 with one weld point 18 each. In these examples the mounting structure 13 has in each case only one holding arm 15 and is constructed on the whole in the shape of a hook. Near its free end the holding arm 15 is connected by a weld point 18 to the carrier shaft 14.

Figure 7:
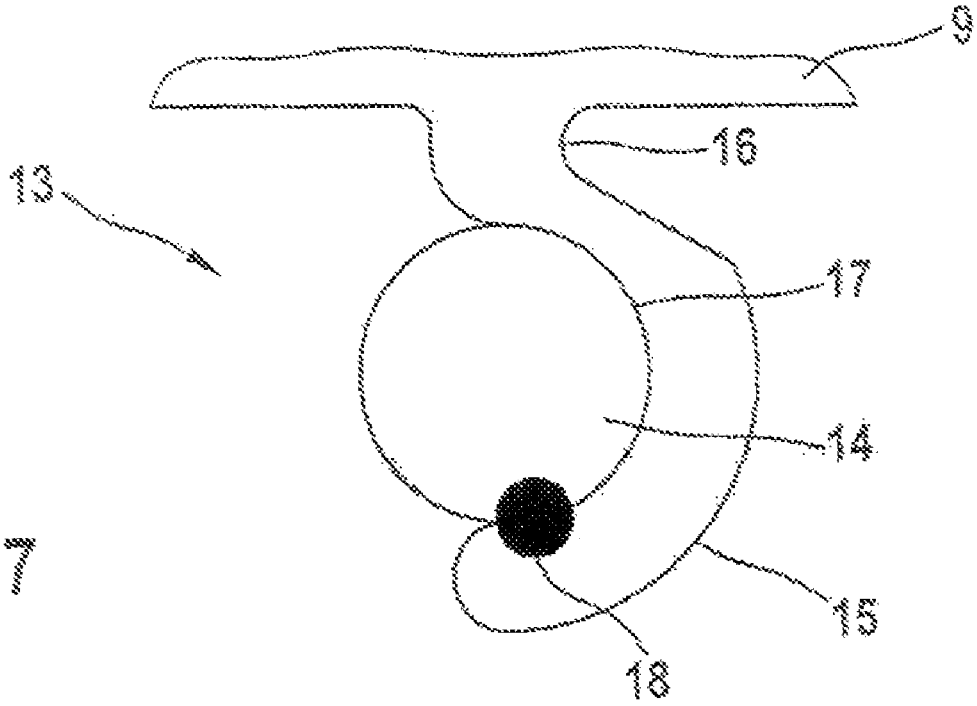
FIGS. 7 to 10 are views of embodiments of the shaving cutter in a representation corresponding to FIG. 4, showing the respective mounting structures fixedly located on the carrier with single weld points.
Figure 8:
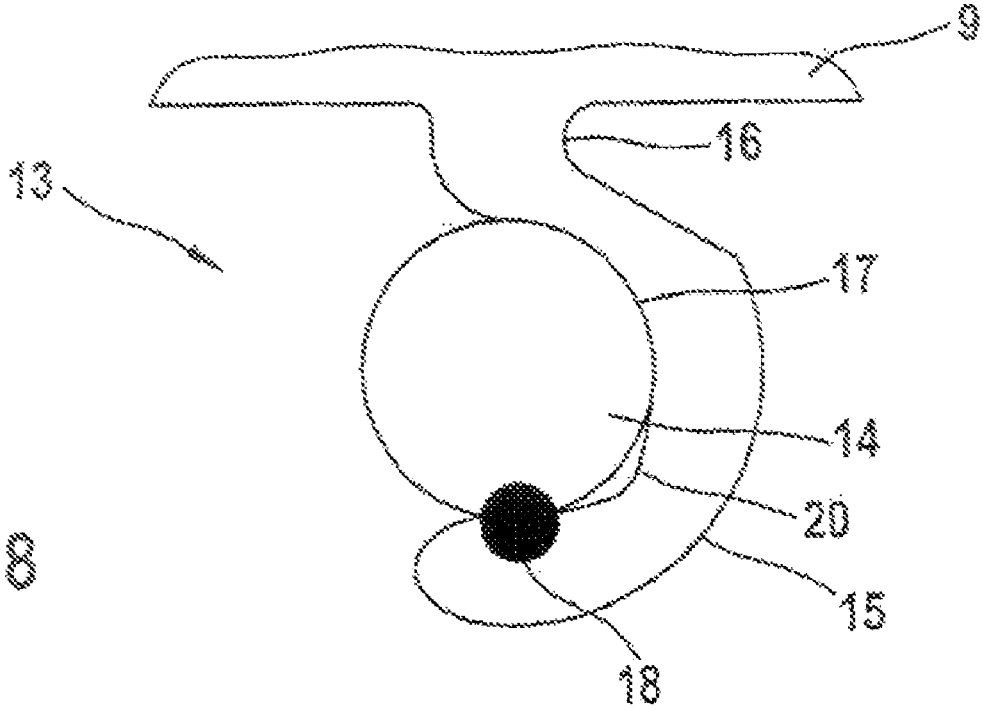

In the examples of FIGS. 7 and 8, the respective holding arm 15 embraces approximately half the circumferential area of the carrier shaft 14. In the embodiment of FIG. 7 the inner surface 17 of the holding arm 15 is constructed fully in the shape of a circular arc. The example of FIG. 8 has, adjacent to the weld point 18, a gap 20 such that the inner surface 17 of the holding arm 15 is constructed only locally in the shape of a circular arc.

Figure 9:
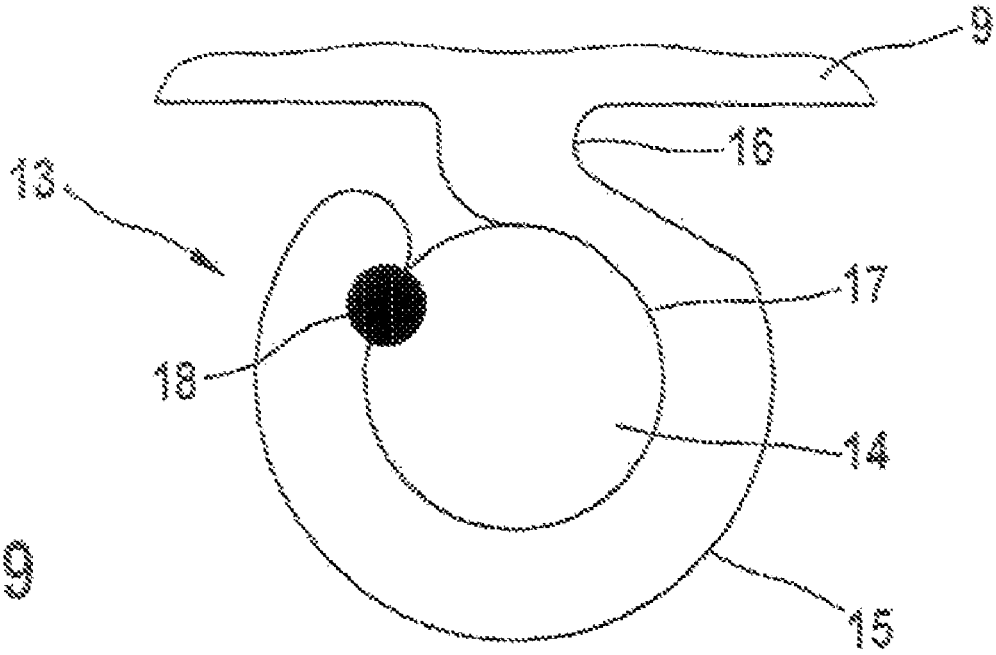
Figure 10:
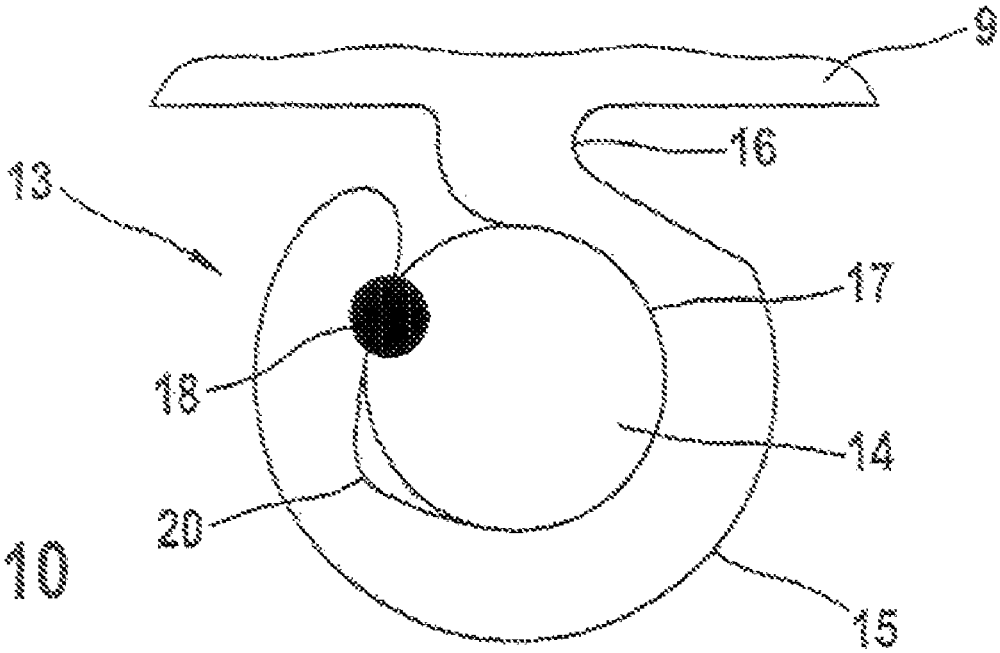

In the examples of FIGS. 9 and 10, the respective holding arm 15 embraces the carrier shaft 14 nearly completely such that the free end of the holding arm 15 nearly reaches in each case to the web 16. In these examples, too, the weld point 18 is again produced in each case near the free end of the holding arm 15. In the example of FIG. 9 the holding arm 15 has a circular-arc-shaped inner surface 17. In the example of FIG. 10, a gap 20 is formed adjacent to the weld point 18. Outside the gap 20, the inner surface 17 of the holding arm 15 is of a circular-arc-shaped configuration.

The weld points 18 can be produced not only by the previously described laser welding method but also by other welding methods, such as micro-plasma welding or electron beam welding, for example.

A number of embodiments of the invention have been described. Nevertheless, it will be understood that various modifications may be made without departing from the spirit and scope of the invention. For example, multiple carriers may be used to transfer motion from the appliance drive mechanism to the shaving cutter and any number of other reinforcing structures, such as cross-members, may be use with the shaving cutter. Accordingly, other embodiments are within the scope of the following claims.

What is claimed is:

1. A shaving cutter assembly for an electric hair cutting appliance, the shaving cutter assembly comprising:

a shaving cutter including first and second longitudinal bases and multiple blades extending between the first and second bases;

first and second opposed mounting structures extending respectively from the first and second bases, wherein the mounting structures, the bases and the blades are integrally formed from a common sheet of material;

a carrier fixedly connected to the first and second opposing mounting structures on the first and second bases by at least one metallic weld, wherein the carrier is a metal shaft and the mounting structures each define a pocket that receives its respective carrier shaft; and wherein each of the mounting structures includes a web of reduced cross-section between each of the first and second bases and a respective weld, wherein the web is configured to substantially isolate the shaving cutter from weld induced stress and wherein one of the mounting structures is shaped so as to define a gap between the mounting structure and its connected carrier shaft in a region adjoining a weld.

2. The shaving cutter assembly according to claim 1 wherein the mounting structures are configured to be deformable to isolate residual welding stresses.

3. The shaving cutter assembly according to claim 1, wherein the pockets of the mounting structures are defined by inner surfaces of the mounting structures that conform to the shape of the carrier shafts.

4. The shaving cutter assembly according to claim 1, wherein one of the mounting structures has at least one holding arm.

5. The shaving cutter assembly according to claim 4, wherein one of the mounting structures includes two symmetrically constructed holding arms between which the carrier is arranged.

6. The shaving cutter assembly according to claim 1, wherein the shaving cutter is constructed as an undercutter adapted to be driven in an oscillating motion via the carrier.

7. The shaving cutter assembly according to claim 6, in combination with a shaving overcutter configured to extend over the undercutter to cooperate with the undercutter to sever hairs by relative motion between the undercutter and the overcutter.

8. The shaving cutter assembly according to claim 1, wherein each base is secured to the carrier at multiple discrete welds.

9. The shaving cutter assembly according to claim 8, wherein the multiple welds securing each base to the carrier are arranged such that residual stresses caused by the welds are at least partially canceled.

10. The shaving cutter assembly according to claim 8, wherein the welds are formed at mutually symmetrical locations on the mounting structures.

11. The shaving cutter assembly according to claim 1, wherein the multiple blades are bent such that the shaving cutter has a U-shaped cross-section.

12. The shaving cutter assembly according to claim 1, wherein the common sheet of material has a thickness of less than 1 mm.

13. The shaving cutter assembly according to claim 12, wherein the thickness is about 0.3 mm.

14. The shaving cutter assembly of claim 1, further comprising third and fourth opposed mounting structures extending from the first and second bases and a second carrier connected between the third and fourth opposed mounting structures.

15. The shaving cutter assembly of claim 1, wherein the carrier comprises a metal shaft to which both bases are welded to form a solid connection between the bases.

16. An electric hair cutting appliance comprising:

a housing containing a drive system;

a shaving head attached to the housing;

a shaving cutter assembly disposed within the shaving head and comprising:

a shaving cutter including first and second longitudinal bases, multiple blades extending between the first and second bases, and first and second opposed mounting structures extending respectively from the first and second bases, wherein the mounting structures, the bases and the blades are integrally formed from a common sheet of material;

a carrier fixedly connected to both the first and second mounting structures by at least one metallic weld and configured to be driven by the drive system to cause the shaving cutter to oscillate, wherein one of the mounting structures is shaped so as to define a gap between the mounting structure and its connected carrier shaft in a region adjoining a weld; and a shaving foil adjacent the shaving cutter assembly.

* * * * *